US012158147B2

(12) United States Patent
Young et al.

(10) Patent No.: US 12,158,147 B2
(45) Date of Patent: Dec. 3, 2024

(54) SLIDE VALVE OF A SINGLE SCREW COMPRESSOR

(71) Applicant: J & E Hall Limited, Dartford (GB)

(72) Inventors: Terence William Thomas Young, Gravesend (GB); John Michael Roll, Fawkham (GB); Maghmood Van Der Poll, Erith (GB)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/431,709

(22) PCT Filed: Feb. 20, 2020

(86) PCT No.: PCT/GB2020/050405
§ 371 (c)(1),
(2) Date: Aug. 17, 2021

(87) PCT Pub. No.: WO2020/169978
PCT Pub. Date: Aug. 27, 2020

(65) Prior Publication Data

US 2022/0136506 A1 May 5, 2022

(30) Foreign Application Priority Data

Feb. 22, 2019 (GB) ..... 1902468

(51) Int. Cl.
*F04C 18/52* (2006.01)
*F04C 28/12* (2006.01)

(52) U.S. Cl.
CPC ..... *F04C 18/52* (2013.01); *F04C 28/12* (2013.01)

(58) Field of Classification Search
CPC ..... F04C 18/52; F04C 28/12
See application file for complete search history.

(56) References Cited

U.S. PATENT DOCUMENTS

| | | | | |
|---|---|---|---|---|
| 4,747,755 | A | 5/1988 | Ohtsuki et al. | |
| 8,702,408 | B2 * | 4/2014 | Young | F04C 18/52 418/201.2 |

FOREIGN PATENT DOCUMENTS

| | | | | |
|---|---|---|---|---|
| CN | 105508243 | A | 4/2016 | |
| EP | 2444671 | A1 | 4/2012 | |
| GB | 1555329 | A | 11/1979 | |
| GB | 1555330 | A | 11/1979 | |
| GB | 2119856 | A | 11/1983 | |
| GB | 2538390 | A | 11/2016 | |
| GB | 2581526 | | 8/2020 | |
| JP | 2018009516 | A | 1/2018 | |
| WO | 2010146793 | A1 | 12/2010 | |
| WO | WO-2017145251 | A1 * | 8/2017 | F04C 18/52 |

(Continued)

*Primary Examiner* — Mary A Davis
(74) *Attorney, Agent, or Firm* — Rahman LLC

(57) ABSTRACT

A single screw compressor comprises a main rotor and at least one gate rotor, a casing for the main rotor having a discharge port at a discharge end of the casing, and a slide slidable within a bore in the casing adjacent the main rotor. The slide has a cut-out (6) between first (2) and second (4) sealing parts of the slide, the slide is slidable between a high volume ratio position where the cut-out (6) is within the casing and provides a path to the discharge port, and a low volume ratio position where the slide is beyond the discharge end of the casing to provide a fixed discharge path in the bore of the casing.

2 Claims, 5 Drawing Sheets

(56) References Cited

FOREIGN PATENT DOCUMENTS

| | | | |
|---|---|---|---|
| WO | 2017149659 | A1 | 9/2017 |
| WO | 2017203608 | A1 | 11/2017 |
| WO | 2019064187 | A1 | 4/2019 |
| WO | 2020169978 | A1 | 8/2020 |

* cited by examiner

SLIDE VALVE OF A SINGLE SCREW COMPRESSOR

BACKGROUND TO THE INVENTION

This invention relates to a single screw compressor with a variable volume ratio (VR).

Screw compressors traditionally use slides to control the capacity of the compressor and/or the volume ratio of the compression process.

Capacity control slides, such as that shown in FIG. 1, conventionally operate in the axial plane along the rotor(s). The suction end of the slides delays the start of compression by opening a bypass port during the early rotation period of the main rotor, thereby effectively reducing the swept volume (capacity) of the compressor. At the same time the delivery port opening is delayed, thus maintaining approximately constant VR during most of the compression process.

Variable frequency drives are now commonly used to provide capacity control of screw compressors. However the slides are retained to provide a variable volume ratio function.

As operating conditions change, the required built in volume ratio needs to change to match these changing conditions, if optimum efficiency is to be achieved. An example of a variable volume ratio slide is shown in FIG. 2. This can be considered as a modification of the conventional capacity control slide. This is achieved by extending the suction end of the slide such that no bypass port to suction is opened during the full axial movement of the slide. The slide VR port is then designed to provide the varying volume ratio as the rotor flute opens to the discharge port via the slide VR port.

The conventional VVR slide has the disadvantage that it must extend from the discharge port to the end of the rotor such that even when the slide is at the highest VR position (travel towards the discharge end of the rotor) the suction end of the rotor is sealed and no bypassing to suction can occur. This slide must have clearance in the slide bore if it is to move freely. This clearance provides a leakage path directly from discharge to suction and to a lesser extent intermediate pressure also sealed by the slide can leak to suction. This leakage occurs when the slide is at any position and results in an unwanted reduction in compressor efficiency. FIG. 3 schematically shows the slide in place in the compressor and FIG. 4 shows the slide leakage paths 1.

SUMMARY OF THE INVENTION

It is an aim of the invention to eliminate this leakage path from discharge to suction and thereby to improve the base efficiency.

The invention employs a simple two step arrangement, which can match the efficiency of a true fully modulating variable VR slide due to the reduced leakage effect.

The present invention provides a single screw compressor comprising a main rotor and at least one gate rotor, a casing for the main rotor having a discharge port at a discharge end of the casing, and a slide slidable within a bore in the casing adjacent the main rotor, the slide having a cut-out between first and second sealing parts of the slide, the slide being slidable between a high volume ratio position where the cut-out is within the casing and provides a path to the discharge port, and a low volume ratio position where the slide is beyond the discharge end of the casing to provide a fixed discharge path in the bore of the casing.

In one embodiment, the first, i.e. upstream, sealing part of the rotor, has a surface facing away from the cut-out that is substantially in a plane transverse to the axes of the slide and the main rotor. This is for ease of manufacture.

In an alternative embodiment, the first, sealing part of the rotor, has a surface facing away from the cut-out that is inclined to a plane transverse to the axes of the slide and the main rotor at an angle substantially the same as the main rotor pitch angle. This gives accurate VR control.

BRIEF DESCRIPTION OF THE DRAWINGS

The invention will now be described in more detail, by way of example only, with reference to the accompanying drawings, in which.

DETAILED DESCRIPTION OF PARTICULAR EMBODIMENTS

Figure 1:
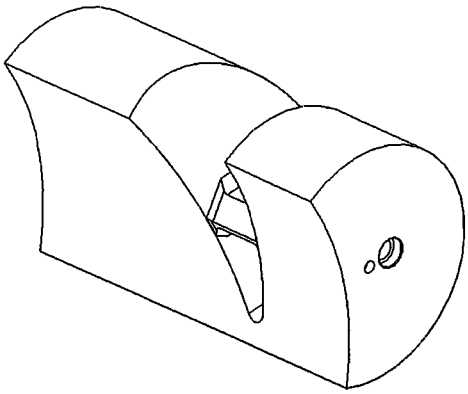
Fig. 1 (Prior Art)
FIG. 1 shows the known capacity control slide discussed above.
Figure 2:
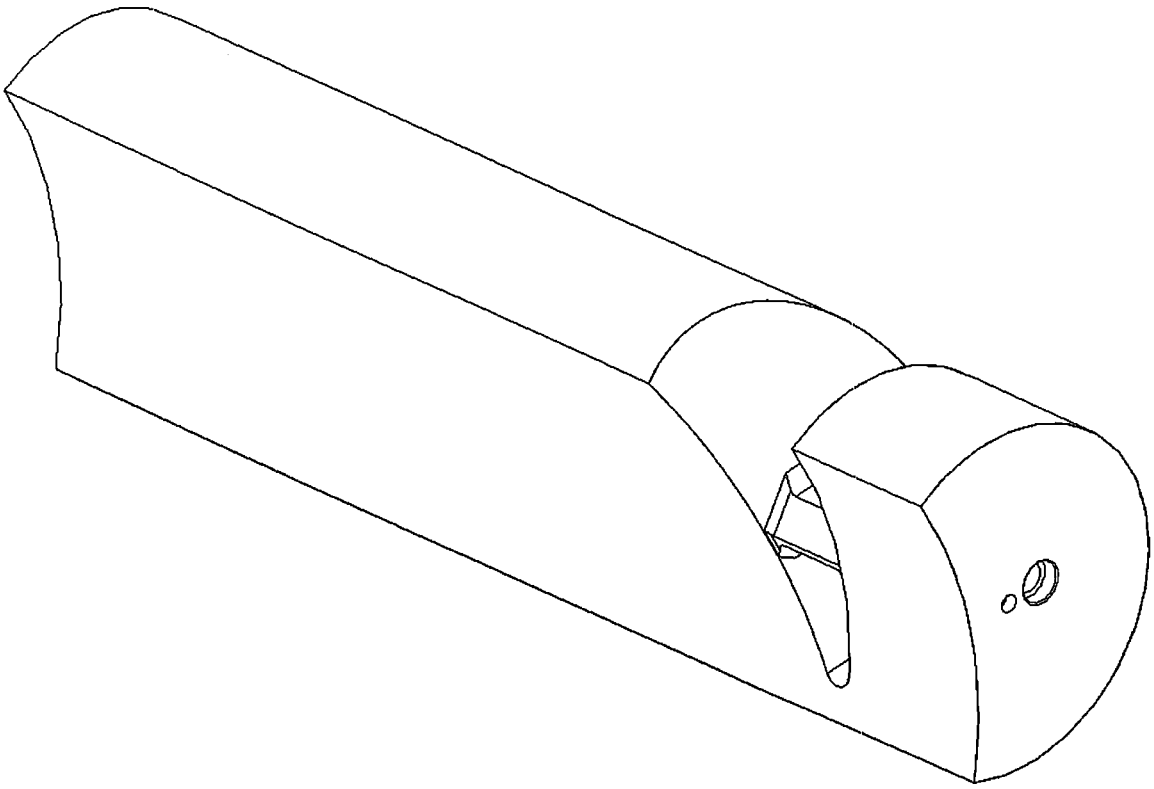
Fig. 2 (Prior Art)
FIG. 2 shows the known VR control slide discussed above.
Figure 3:
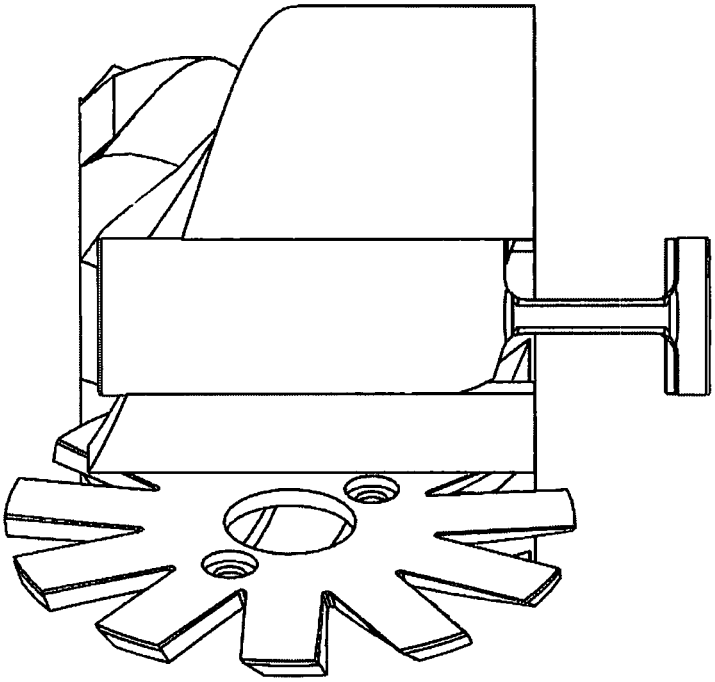
Fig. 3 (Prior Art)
FIGS. 3 and 4 are views showing the known VR control slide and its leakage paths.
Figure 4:
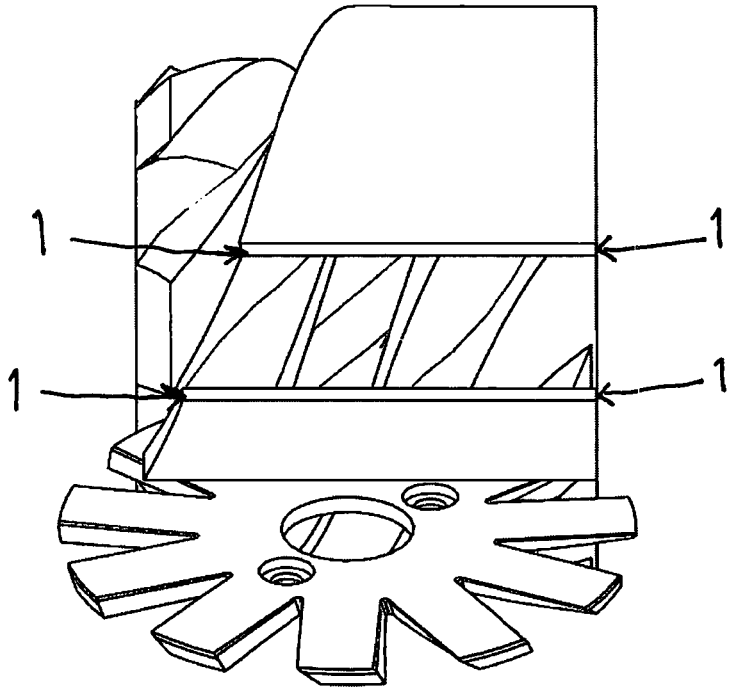
Fig. 4 (Prior Art)
Figure 5:
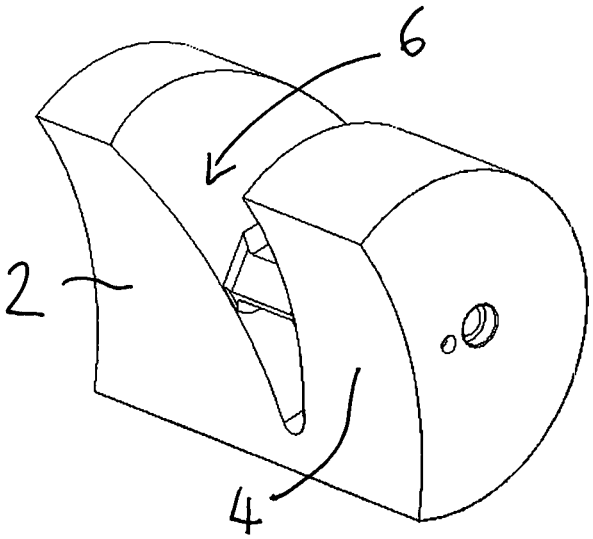
FIG. 5 shows a slide according to an embodiment of the invention.

FIG. 5 shows a slide according to the invention having sealing parts 2, 4 and a cut-out 6.

Figure 6:
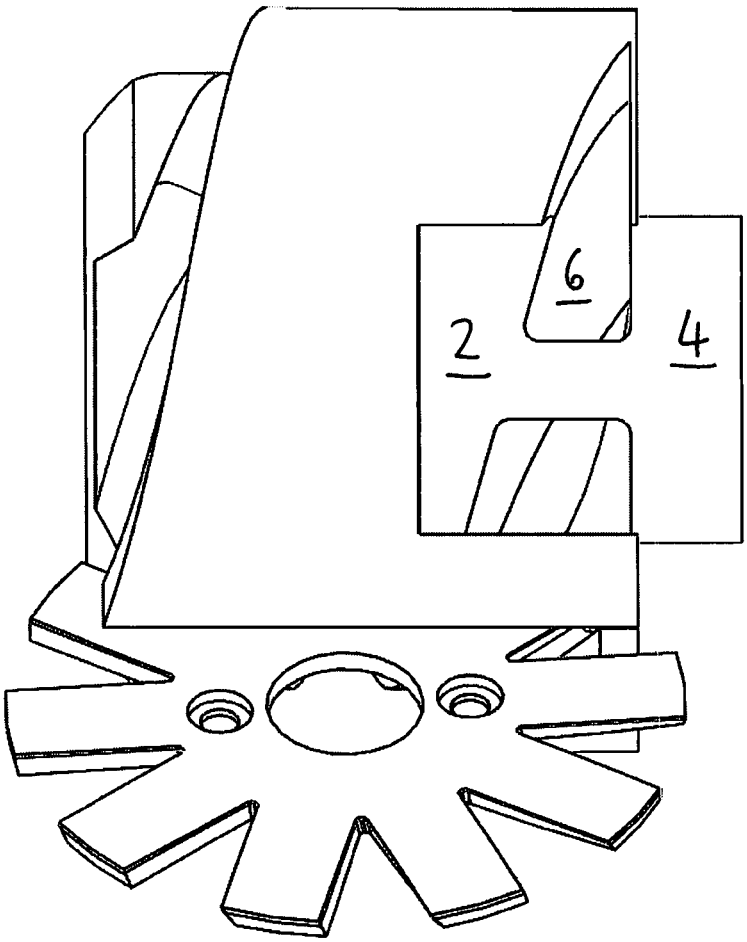
FIGS. 6 and 7 show the slide of FIG. 5 at different positions in the compressor.

FIG. 6 shows the slide of FIG. 5 positioned in towards the main casing alongside the main rotor. The cut-out 6 provides an accurate high VR discharge port.

Figure 7:
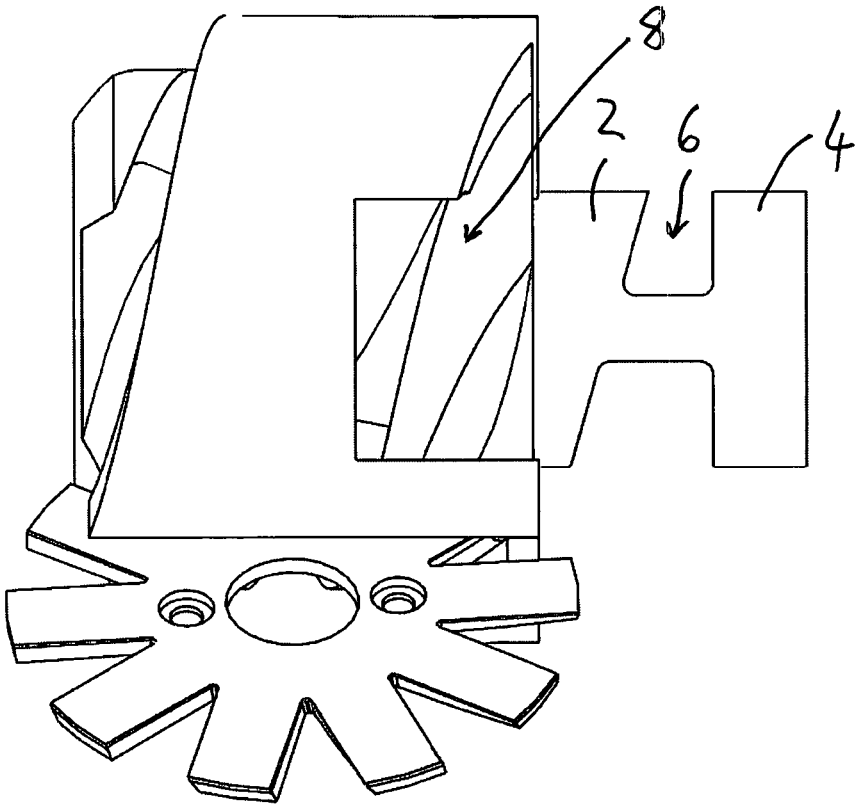

FIG. 7 shows how a lower VR is achieved. The slide is pulled out from the casing so that it is beyond the main rotor and thus the VR is formed from the port 8 remaining in the casing.

The slide of FIGS. 5 to 7 is a simple slide. The higher VR slide discharge port provided by the cut-out 6 correctly aligns with the rotor flute, but when the slide is withdrawn beyond the rotor the remaining low VR fixed port does not match the true VR requirement.

Figure 8:
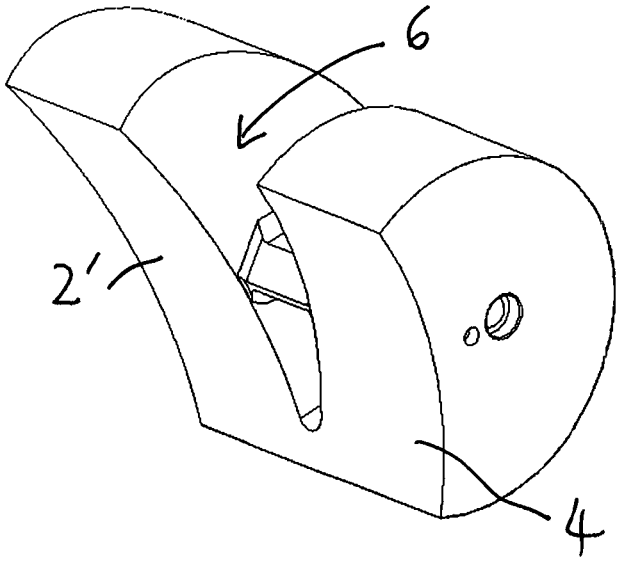
FIG. 8 shown a slide according to an alternative embodiment.
Figure 9:
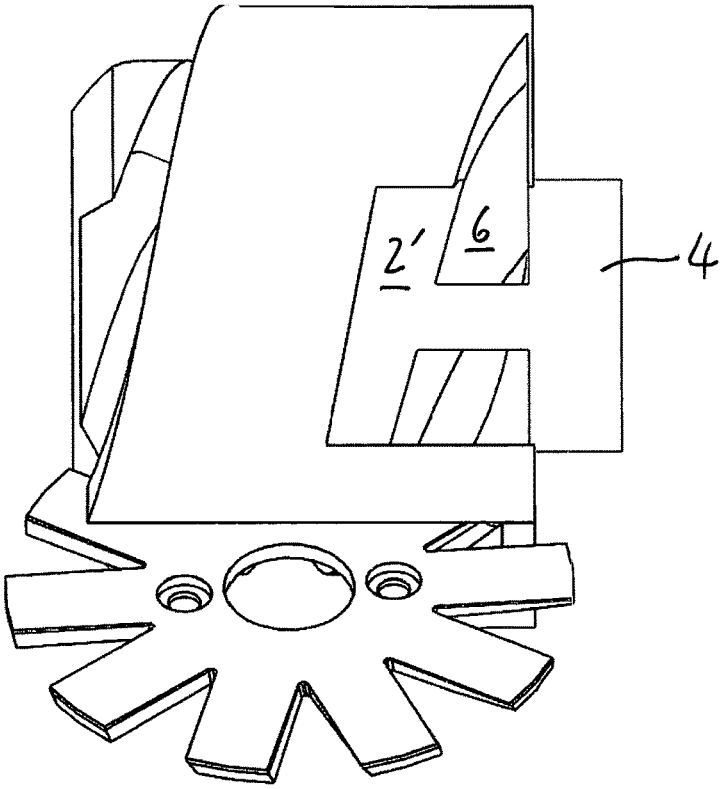
FIGS. 9 and 10 show the slide of FIG. 5 at different positions in the compressor.
Figure 10:
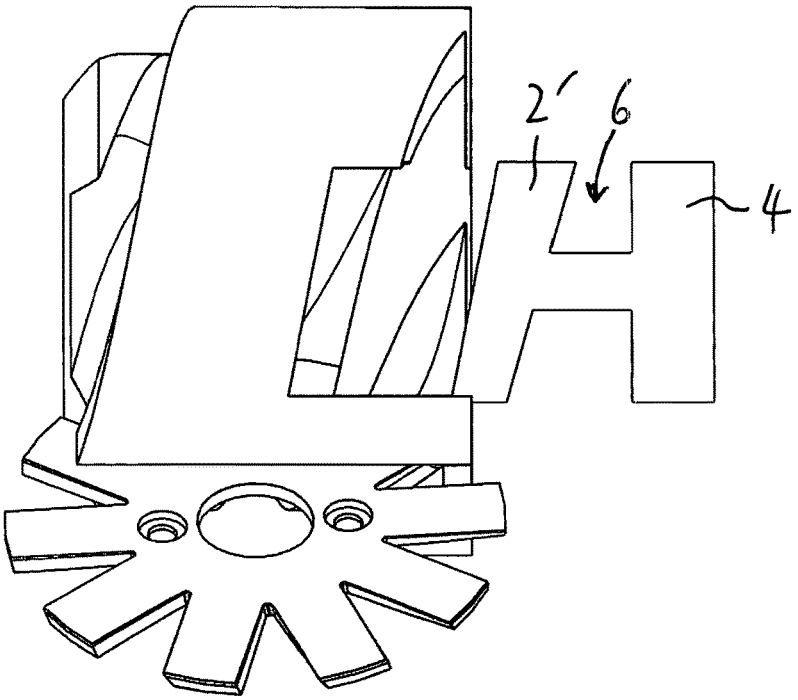

FIGS. 8 to 10 show an alternative slide which has the same high VR cut-out as the slide of FIGS. 5 to 7. However this slide also has the correct low VR remaining in the casing when the slide is moved out of engagement beyond the rotor as shown in FIG. 10.

The simple slide of FIGS. 5 to 7 is easier to produce and the VR compromise is less detrimental at the Low VR operating conditions than at higher VR conditions. The true VR slide of FIGS. 8 to 10 will provide the highest efficiency.

The invention claimed is:

1. A single screw compressor comprising:

a main rotor;

at least one gate rotor; and a casing for the main rotor, wherein the casing comprises:

a first end comprising a discharge port;

a second end being opposite from the first end and in an axial direction of the main rotor;

a bore adjacent to the main rotor, wherein the bore comprises a first bore end and a second bore end, and wherein a distance between the second bore end and the second end of the casing is smaller than a distance between the first bore end and the second end of the casing; and a slide slidable within the bore, wherein the slide comprises a cut-out between a first upstream sealing part and a second downstream sealing part of the slide, wherein the first upstream sealing part of the slide comprises a surface facing away from the cut-out that is inclined to a plane transverse to the axes of the slide and the main rotor at an angle substantially the same as the main rotor pitch angle, the surface facing the first bore end, wherein the slide is slidable between a high volume ratio position where the cut-out is within the casing and provides a path to the discharge port, and a low volume ratio position where an entire first upstream sealing part of the slide is beyond the first end of the casing to provide a fixed discharge path in the bore of the casing, wherein, during the low volume ratio position, a gap exists between a portion of the surface of the first upstream sealing part of the slide facing away from the cut-out and the discharge port, wherein the second bore end is positioned closer to the first bore end than the second end of the casing is positioned relative to the first bore end, and wherein the main rotor sucks a refrigerant from a gap between the main rotor and the second end of the casing, compresses the refrigerant working with the at least one gate rotor, and discharges the refrigerant to the discharge port.

2. The single screw compressor according to claim 1, wherein the second bore end is positioned closer to the discharge port than the second end of the casing is positioned relative to the discharge port.

* * * * *